US008438965B2

(12) United States Patent
Collin et al.

(10) Patent No.: US 8,438,965 B2
(45) Date of Patent: May 14, 2013

(54) MOUNTING DEVICE FOR WEAPON

(75) Inventors: Fred Collin, Ann Arbor, MI (US); Alan Charlton, Saline, MI (US); Mike Carlson, Saline, MI (US); Michael L. Marino, Ann Arbor, MI (US)

(73) Assignee: OptiFlow, Inc., Ann Arbor, MI (US)

( * ) Notice: Subject to any disclaimer, the term of this patent is extended or adjusted under 35 U.S.C. 154(b) by 180 days.

(21) Appl. No.: 12/819,506

(22) Filed: Jun. 21, 2010

(65) Prior Publication Data

US 2011/0067287 A1 Mar. 24, 2011

Related U.S. Application Data

(60) Provisional application No. 61/245,087, filed on Sep. 23, 2009.

(51) Int. Cl.
*F41G 1/387* (2006.01)

(52) U.S. Cl.
USPC ..... 89/125

(58) Field of Classification Search ..... 42/124, 42/125, 127, 128
See application file for complete search history.

(56) References Cited

U.S. PATENT DOCUMENTS

| | | | | |
|---|---|---|---|---|
| 3,877,166 | A * | 4/1975 | Ward | 42/127 |
| 4,835,895 | A | 6/1989 | Bowen | |
| 5,142,806 | A | 9/1992 | Swan | |
| 5,155,915 | A | 10/1992 | Repa | |
| 5,276,988 | A | 1/1994 | Swan | |
| 5,375,361 | A * | 12/1994 | Rustick | 42/125 |
| 5,570,529 | A | 11/1996 | Amelino | |
| 5,680,725 | A | 10/1997 | Bell | |
| 6,435,738 | B1 * | 8/2002 | Vogt | 396/419 |
| 6,442,883 | B1 | 9/2002 | Waterman et al. | |
| 6,637,144 | B2 | 10/2003 | Nelson et al. | |
| 6,931,778 | B1 | 8/2005 | Nelson et al. | |
| 7,107,716 | B1 | 9/2006 | Liao | |
| 7,204,052 | B2 | 4/2007 | Swan | |
| 7,308,772 | B1 | 12/2007 | Millett | |
| 7,370,449 | B1 | 5/2008 | Beckmann | |
| 7,493,721 | B2 | 2/2009 | Swan | |
| 7,562,485 | B2 | 7/2009 | Newhall et al. | |
| 7,712,242 | B2 | 5/2010 | Matthews et al. | |
| 7,739,824 | B1 | 6/2010 | Swan | |
| 7,823,316 | B2 | 11/2010 | Storch et al. | |

(Continued)

OTHER PUBLICATIONS

Printout of Trijicon, Inc. system (believed to have been offered for sale, publicly used, and/or published prior to the filing date of this application).

*Primary Examiner* — Stephen M Johnson
(74) *Attorney, Agent, or Firm* — Gifford, Krass, Sprinkle, Anderson & Citkowski, P.C.

(57) ABSTRACT

A mounting device for mounting an accessory to a rail of a weapon includes a base portion and first and second side portions. One side portion is movable to grip the rail. An elongated connecting member has a first end engaging the first side portion and a second end connected to a camming device. The camming device engages the second side portion and pulls the elongated connecting member to move the side portions to an engaged position. A locking mechanism locks the camming device in the closed position. The locking mechanism includes a locking element that is movable between a lock position and an unlock position. The locking element has an engagement portion that selectively engages the camming device when the locking element is in the lock position thereby locking the camming device in the closed position.

27 Claims, 17 Drawing Sheets

U.S. PATENT DOCUMENTS

2002/0162267 A1 11/2002 Nelson et al.
2006/0117636 A1 6/2006 Newhall et al.
2006/0207156 A1 9/2006 Larue
2008/0047190 A1 2/2008 May
2008/0092421 A1 4/2008 Beckmann
2008/0092422 A1 4/2008 Daniel et al.
2008/0155876 A1 7/2008 Matthews et al.
2008/0178511 A1 7/2008 Storch et al.
2008/0216380 A1 9/2008 Teetzel
2009/0038201 A1 2/2009 Cheng et al.

* cited by examiner

MOUNTING DEVICE FOR WEAPON

REFERENCE TO RELATED APPLICATION

This application claims priority from U.S. Provisional Patent Application Ser. No. 61/245,087, filed Sep. 23, 2009, the entire content of which is incorporated herein by reference.

FIELD OF THE INVENTION

The present invention relates generally to devices for mounting accessories to a weapon.

BACKGROUND OF THE INVENTION

A weapon such a rifle is often used in combination with one or more accessories, such as a sighting scope. It is common for the weapon to have a mounting rail and accessories are designed to mount to this mounting rail. Such mounting rails may be generally referred to as receiver rails. One type of receiver rail is a Weaver Rail.

A variety of mounting devices have been developed to allow accessories to be securely clamped to a receiver rail on a weapon. However, each of these mounting devices has certain limitations.

SUMMARY OF THE INVENTION

The present invention provides various embodiments of a mounting device for mounting an accessory to a rail of a weapon.

A first embodiment of a mounting device includes a base portion, a first side portion configured to engage a first side of a rail of a weapon, and a second side portion configured to engaged a second side of a rail of a weapon, the second side being opposite the first side. One of the side portions is movable relative to the other of the side portions such that the side portions cooperate to selectively grip the rail of the weapon. An elongated connecting member has a first end engaging the first side portion. A camming device is interconnected with a second end of the elongated connecting member. The camming device engages the second side portion and is operable to pull the elongated connecting member such that the side portions are moved from a released position to an engaged position. The camming device includes a lever that moves the camming device between an open and a closed position. A locking mechanism is operable to lock the camming device in the closed position. The locking mechanism includes a locking element that is supported by the base portion or the side second portion and is movable between a lock position and an unlock position. The locking element has an engagement portion that selectively engages the camming device when the locking element is in the lock position thereby locking the camming device in the closed position.

In some embodiments, the locking element is a latch that is pivotally interconnected with the base portion or the second side portion. The engagement portion of the latch is a catch that engages the camming device in the lock position. The latch may include a pivot end that is pivotally interconnected with the base portion or the second side portion and a catch end including the catch. A button may be defined between the pivot end and the catch end for moving the latch. The mounting device may include a spring biasing the latch towards the lock position. In some version, the camming device has a cam portion with a recess defined therein, and the catch engages the recess in the lock position.

In some embodiments, the base portion of the mounting device has an opening defined therein and the movable side portion is slidingly received in the opening. The other side portion is fixed with respect to the base portion. In some versions, the first side portion is the movable side portion and the second side portion is the side portion that is fixed with respect to the base portion. The second side portion may be integral with the base portion. A spring may be provided for biasing the movable one of the side portions away from the other of the side portions.

In some embodiments, the camming device includes a cam portion that is interconnected with the second end of the connecting member. The second end of the connecting member or the cam portion has a slot disposed therein, and a pin interconnects the other of the second end or the cam portion with the slot.

In some embodiments, the second side portion has a curved cam receiving surface defined thereon, and the cam portion of the camming device is disposed against the curved cam receiving surface.

In some embodiments, the elongated connecting member has a mid portion extending between the first and second ends and the first end of the connecting member is an adjusting nut threadingly engaged with the mid portion. The second side portion having a nut receiving area defined thereon and the adjusting nut is disposed so as to engage the nut receiving area. The nut receiving area and the adjusting nut have corresponding engagement features such that when the adjusting nut is disposed in engagement with the receiving area, the engagement features engage each other. In some versions, the engagement features are a hardened ball in the nut receiving area and a plurality of detents defined on the nut. In further versions, the nut receiving area is a nut receiving recess, and the nut is at least partially received in the nut receiving recess. A spring may be provided for biasing the second side portion towards the adjusting nut.

In some embodiments, the locking element extends from the second side portion to an outer end with a catch, and the catch selectively engages and retains the lever in the closed position. In some versions of this embodiment, the base portion has an opening defined therein and the movable side portion is slidingly received in the opening. The other side portion is fixed with respect to the base portion.

In some embodiments, the second side portion has a curved earn receiving surface and the camming device has a cam portion disposed against the curved cam receiving surface. The second side portion has a bore defined therein that intersects the curved cam receiving surface. The locking element is received in the bore and has an engagement end that engages the cam portion of the camming device in the lock position.

In some versions of this embodiment, the locking element in the lock position extends into engagement with the cam portion and in the unlock position is retracted so as not to engage the cam portion. In other versions, the engagement end of the locking element includes a first portion and a second portion, with the second portion having a thickness less than the first portion. The locking element is movable between a lock position wherein the first portion is adjacent the cam portion and an unlock position wherein the second portion is adjacent the cam portion. The first portion in the lock position blocks rotation of the camming device, and the second portion in the unlock position does not block rotation of the camming device.

In some embodiments, the mounting device further includes an accessory mounted to the base portion. In some versions, the accessory is a scope.

In some embodiments, a mounting device includes a base portion with an opening defined therein, a first side portion configured to engage a first side of a rail of a weapon, and a second side portion configured to engaged a second side of a rail of a weapon. The side portions cooperate to selectively grip the rail of the weapon. The second side portion has a curved cam receiving portion defined thereon. The first side portion is slidingly received in the opening in the base portion so as to be movable relative to the second side portion. An elongated connecting member has a first end, a second end and a mid portion extending therebetween. The first end is an adjusting nut threadingly engaged with the mid portion and engaging the first side portion. A camming device is interconnected with the second end of the elongated connecting member. The camming device has a cam portion engaging the curved cam receiving surface of the second side portion and a lever that moves the camming device between an open and a closed position. The camming device is operable to pull the elongated connecting member such that the side portions are moved from a released position to an engaged position. A locking mechanism is operable to lock the camming device in the closed position. The locking mechanism includes a latch that is pivotally interconnected with the base portion or the second side portion. The latch has a catch that engages a recess in the camming device in a lock position thereby locking the camming device in the closed position.

In some embodiments, a mounting device for mounting an accessory to a rail of a weapon includes a base portion, a first side portion configured to engage a first side of a rail of a weapon, and a second side portion configured to engage a second side of a rail of a weapon. One of the side portions is movable relative to the other of the side portions such that the side portions cooperate to selectively grip the rail of the weapon. An elongated connecting member has a first end and an opposed second end with a mid portion extend therebetween. The first end is an adjusting nut threadingly engaged with the mid portion. The first side portion has a nut receiving area defined thereon. The adjusting nut is disposed so as to engage the nut receiving area. The nut receiving area and the adjusting nut having corresponding engagement features such that when the adjusting nut is disposed in engagement with the nut receiving area, the engagement features engage each other. The engagement features include a hardened ball in the nut receiving area and a plurality of detents defined on the nut. A camming device is interconnected with the second end of the elongated connecting member. The camming device is operable to pull the elongated connecting member such that the side portions are moved from a released position to an engaged position. The camming device includes a lever that is moved between an open and a closed position.

In some versions of this embodiment, the base portion has an opening defined therein and the movable side portion is slidingly received in the opening. The other side portion is fixed with respect to the base portion.

In some embodiments, a mounting device for mounting an accessory to a rail of a weapon includes a base portion, a first side portion configured to engage a first side of a rail of a weapon, and a second side portion configured to engaged a second side of a rail of a weapon. One of the side portions is movable relative to the other of the side portions such that the side portions cooperate to selectively grip the rail of the weapon. An elongated connecting member has a first end engaging the first side portion. A camming device is interconnected with a second end of the elongated connecting member. The camming device is operable to pull the elongated connecting member such that the side portions are moved from a released position to an engaged position. The camming device includes a lever that is moved between an open and a closed position and a cam portion interconnected with the second end of the connecting member. The second end of the connecting member or the cam portion has a slot disposed therein. A pin interconnects the other of the second end or the cam portion with the slot.

In some versions of this embodiment, the second side portion has a curved cam receiving surface. The cam portion of the camming device is disposed against the curved cam receiving surface. In further versions, the base portion has an opening defined therein and the movable side portion is slidingly received in the opening. The other side portion is fixed with respect to the base portion.

Further variations will be clear to those of skill in the art.

DETAILED DESCRIPTION OF THE INVENTION

A mounting device according to the present invention may take a variety of forms. Various embodiments of the present invention are shown in the Figures with the Figures representing scale drawings of some embodiments. However, the present invention is not limited to the illustrated embodiments.

FIGS. 1-6*a* illustrate a first embodiment of a mounting device according to the present invention. The illustrated mounting device is designed to clamp to a receiver rail of a weapon and to attach an accessory, such as a gun site, thereto. An example of a receiver rail is shown at 1 in FIG. 1. The illustrated rail is known as a Weaver rail. The present invention may be configured for use with a Weaver rail or with other rail designs. These rails may be integral with a weapon, typically along an upper surface thereof, or may be added thereto.

In the first embodiment, the mounting device is an independent device to which the accessory or components of the accessory are attached. An exemplary accessory, in this case a scope, is shown at 2 in FIG. 1. Alternatively, the mounting device according to the present invention may form a component of an accessory, such as a scope, and may be attached thereto or integral therewith. Other accessories may also be used. The combination of an accessory and any of the mounts described herein form further embodiments of the present invention.

Figure 1:
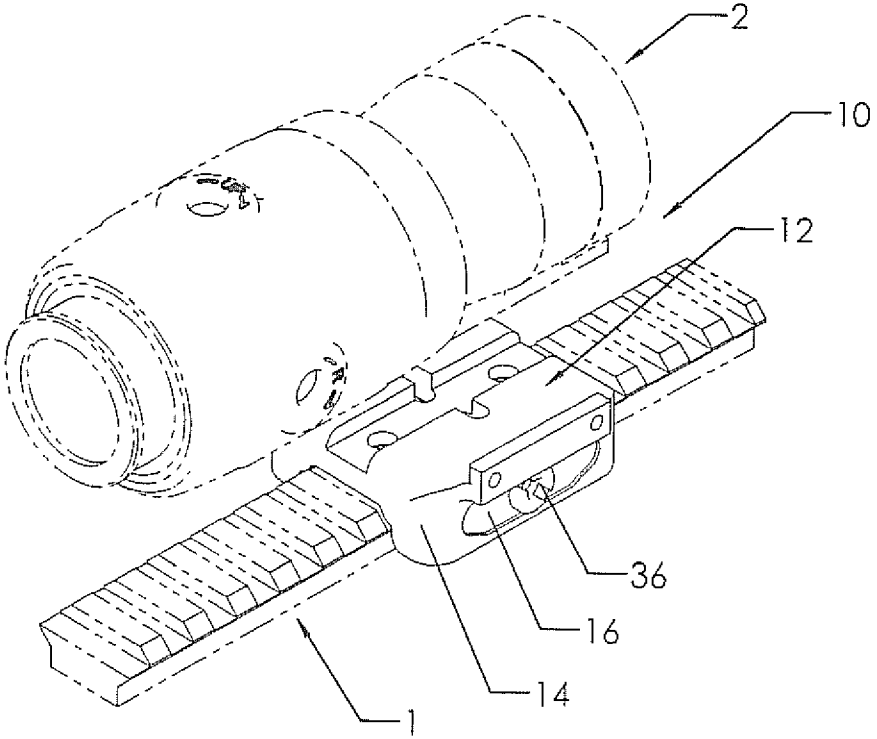
FIG. 1 is perspective view of an embodiment of a mounting device according to the present invention.
Figure 2:
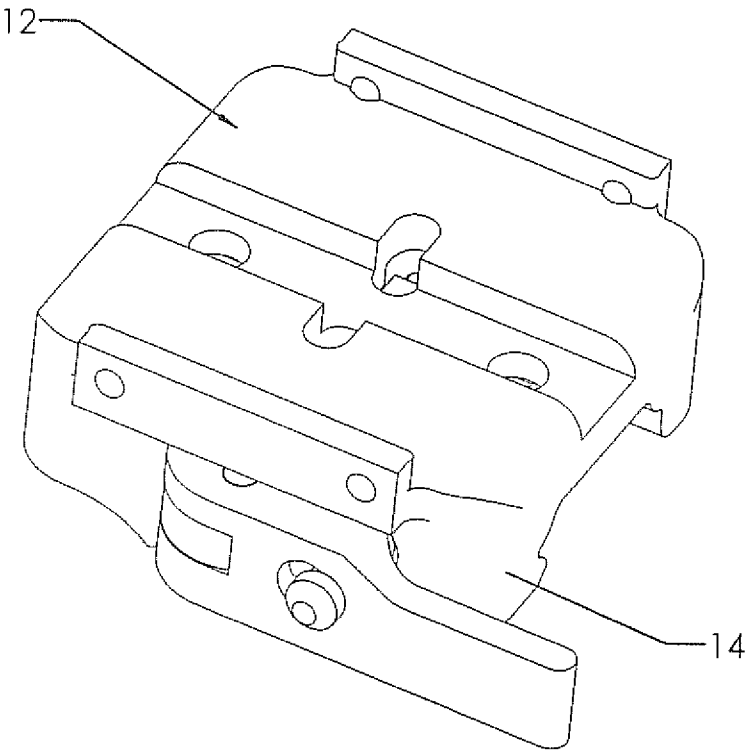
FIG. 2 is a perspective view of the mounting device of FIG. 1 taken from an opposite side.
Figure 3:
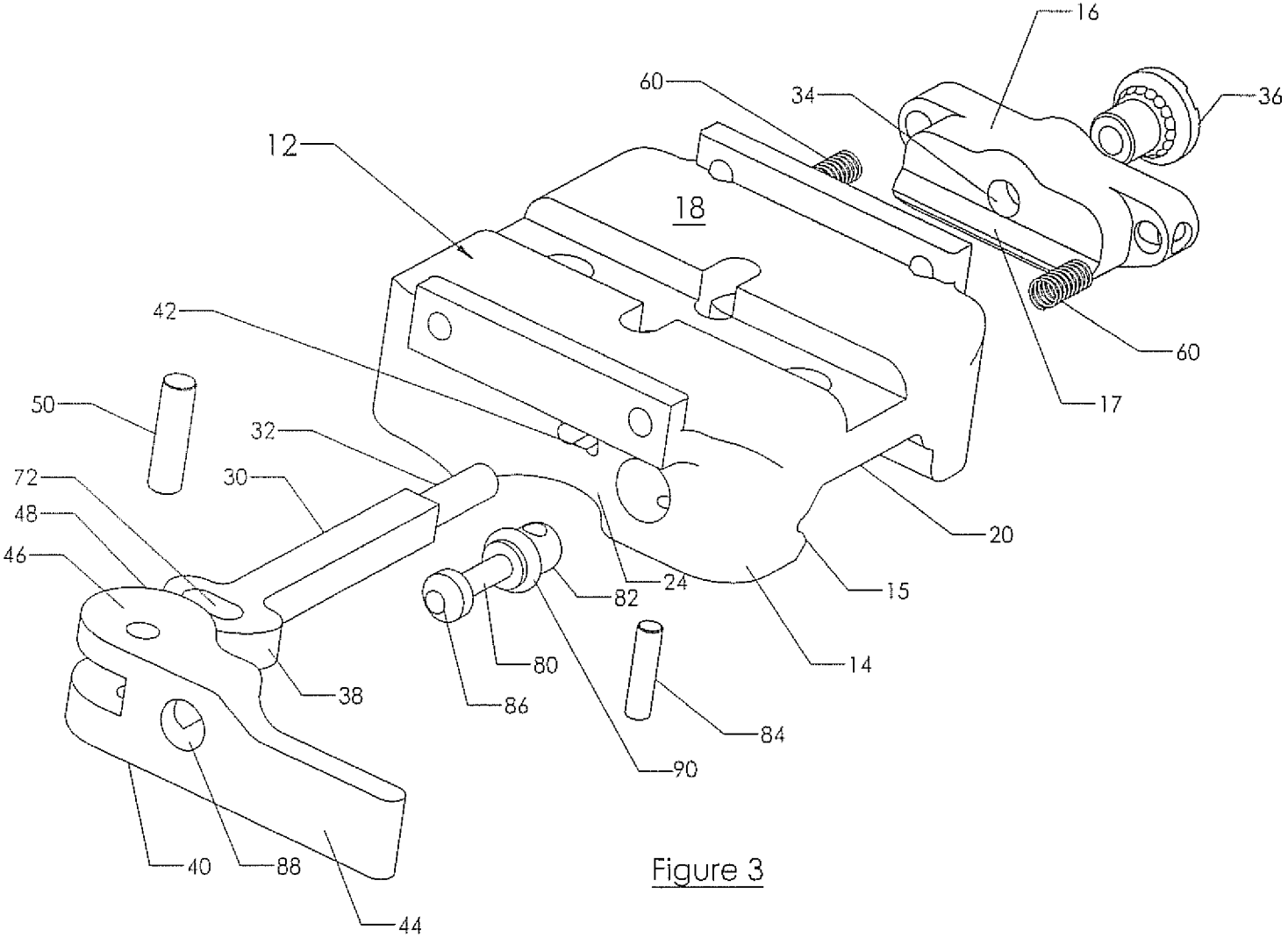
FIG. 3 is an exploded perspective view of the mounting device of FIGS. 1 and 2 shown in the same orientation as in FIG. 2.

As best shown in the exploded view of FIG. 3, the mounting device 10 has a base portion 12 and a pair of side portions 14 and 16. This embodiment of the mounting device is designed to clamp to a receiver rail of the type having a generally flat upper surface and a pair of opposed side surfaces. The base portion 12 has an upper surface 18 and a lower surface 20. As shown, one of the side portions 14 extends downwardly from the lower surface 20 and is integral with the base portion. The other side portion 16 is moveable with respect to the side portion 14. For ease of reference, the side portion 16 will be referred to as a movable side portion while the side portion 14 will be referred to as a fixed side portion. As will be understood, the side portions may be switched or both may be made movable. As such, these labels are not limiting.

Figure 6A:
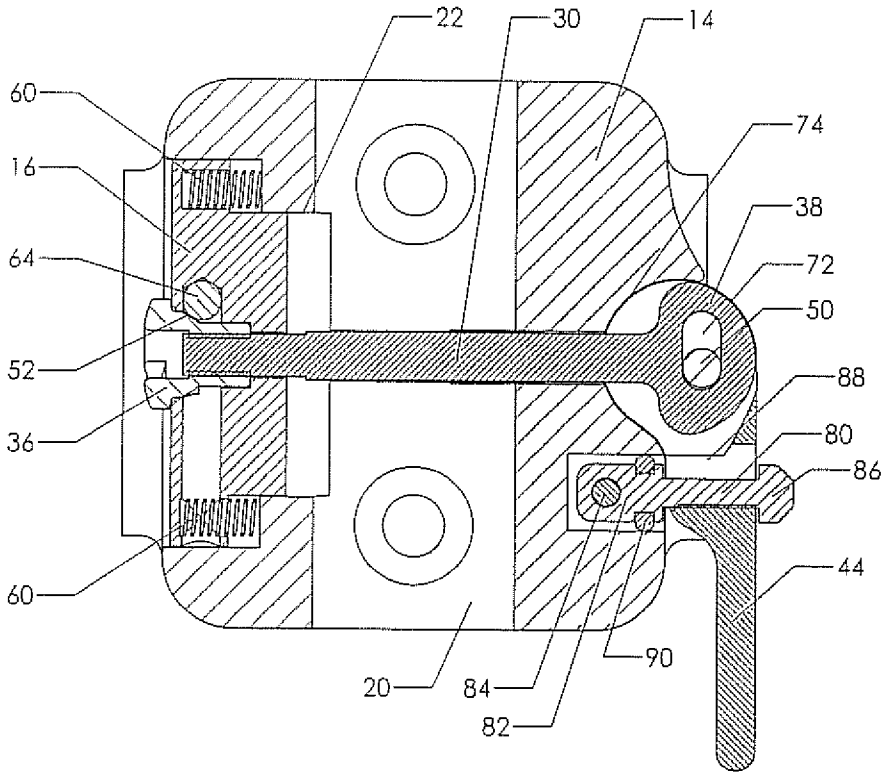
FIG. 6*a* is a cross-sectional view of the mounting device of FIGS. 1-3 and 5 taken along lines A-A of FIG. 5.
Figure 5:
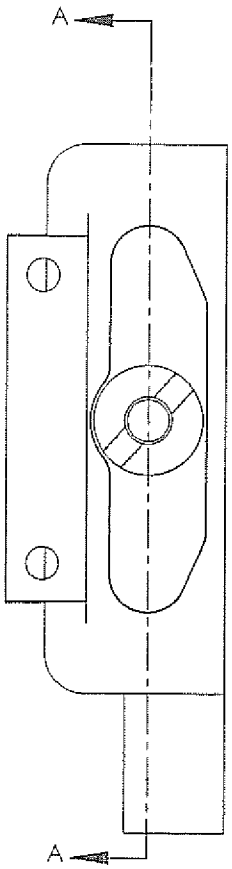
FIG. 5 is a side view of the mounting device of FIGS. 1-3.

The moveable side portion 16 is slidably received in an opening 22, best shown in FIG. 6*a*, in the base portion 12 such that it is opposed to the fixed side portion 14. Both of the side portions 14 and 16 have inwardly facing engagement surfaces, 15 and 17 respectively. The mounting device 10 mounts to the receiver rail by placing the base portion 12 on the receiver rail with the lower surface 20 of the base portion facing the upper surface of the receiver rail. The inner surfaces 15 and 17 of the fixed and movable side portions 14 and 16 may engage the side surfaces of the receiver rail thereby attaching the mounting device thereto.

The mounting device 10 further includes an elongated connecting member 30 and a camming device 40 that cooperate to move the movable side portion 16 relative to the fixed side portion 14, thereby clamping and unclamping the mounting device. The connecting member 30 has a first end 32 that extends through an opening 34 in the movable side portion 16 and threadingly engages an adjusting nut 36. A second end 38 of the connecting member 30 extends through an opening 42 in the side member 14 and is connected to the camming device 40. In this embodiment, the camming device 40 includes a lever 44 that moves the camming device between an open and a closed position. The lever is illustrated in the closed position in each of the Figures. The camming device 40 further has a cam portion 46 connected to the lever 44. The cam portion 46 has an outer cam surface 48 that engages the outer surface of the fixed side portion 14. A pin 50 interconnects the cam portion 46 of the camming device 40 with the second end 38 of the elongated connecting member 30. The location of the pin 50 is offset with respect to the cam surface 48 such that as the lever 44 is moved from the open position to the illustrated closed position the elongated connecting member 30 is pulled towards the fixed side portion 14.

The adjusting nut 36, attached to the second end 32 of the connecting member 30, engages a nut receiving area 52 defined on the movable side portion 16, as best shown in FIG. 6*a*. In this embodiment, the nut receiving area is a recess in the outer side of the movable side portion 16. The adjusting nut 36 is at least partially received in the recess. As the camming device 40 pulls the connecting member 30 towards the fixed side portion, this causes the adjustment nut 36 to pull the movable side portion inwardly in the slot 22 such that the side portions engage the receiving rail. If the lever 44 is moved from the illustrated closed position to an open position, the tension on the connecting member 30 is released and the movable side portion 16 is allowed to move outwardly, thereby releasing the mounting device from the receiver rail.

The mounting device illustrated in FIGS. 1-6*a* has a variety of additional features, some of which will be described in more detail. Any of these features may be used either alone or in combination with any of the other features described in any portion of this application. Referring to FIGS. 3 and 6*a*, springs 60 are disposed between the base portion 12 and the moveable side portion 16 so as to bias the side portion 16 outwardly into the non-clamped or released position. As will be clear to those of skill in the art, other types of arrangements of springs may be provided, or springs may be eliminated if a biasing effect is not desired.

Figure 4:
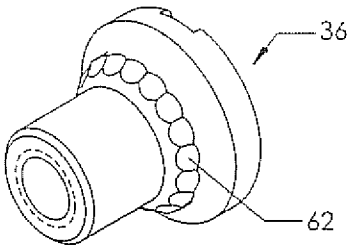
FIG. 4 provides a view of an adjusting nut that forms part of some embodiments of the present invention.

Referring to FIG. 4, a detailed view of one version of the adjusting nut 36 is provided. In this embodiment, the adjusting nut 36 has a plurality of closely spaced detents 62 formed on an inward surface thereof. A hardened ball 64, best shown in FIG. 6*a*, is disposed in the recess in the moveable side portion 16 in a position such that the ball engages these detents 62 when the nut 36 is in contact with the side portion 16. The springs 60 bias the movable side portion 16 outwardly such that the hardened ball 64 engages the detents in the adjusting nut 36. This combination of detents and a hardened ball serve two purposes. First, when the lever 44 is in the closed position, as shown in FIG. 6*a*, the ball 64 locks the adjusting nut 36 in position, preventing rotation of the nut. This prevents the mounting device from loosening over time, even in the presence of vibration. Second, the adjusting nut 36 and hardened ball 64 cooperate to provide small, discrete adjustment steps for the overall mounting device. When the lever 44 is in an open position, the pressure between the nut 36 and the side portion 16 is reduced, with the remaining pressure being primarily due to the bias applied by the springs 60. At this point, the adjusting nut 36 may be rotated such that the detents click past the ball 64 one at a time. This allows an operator to make a discrete adjustment in the position of the nut. As the nut 36 is threadingly engaged with the first end 32 of the connecting member 30, this rotation of the nut slightly changes the relative position of the movable side portion 16 and the fixed side portion 14. As will be clear to those of skill in the art, the adjusting nut 36 may take other forms. For example, the nut may have a knob-like or knurled outer surface to allow easier adjustment without tools. The size, shape, positioning and configuration of the detents and ball may be altered from those illustrated while still accomplishing the features described herein. For example, additional balls may be provided, or a ball may be attached to the nut while detents are provided in the nut receiving area. Further, both the nut and the nut receiving area may have complementary surfaces that cooperate to serve a similar purpose.

As best shown in FIGS. 3 and 6*a*, the second end 38 of the connecting member 30 has a slot 72 disposed therein. The pin 50 extends through the slot 72 so as to interconnect the camming device 40 with the connecting member 30. As best shown in FIG. 6*a*, the second side portion 14 has a curved cam receiving surface 74. This surface 74 matches the profile of the cam surface 48 of the cam portion 46 of the camming device 40 such that the two surfaces engage one another along a continuous curve. Each of these surfaces defines an arc with a center curvature. As will be clear to those of skill in the art, the pin 50 is offset with respect to this center of curvature. As will be clear from FIG. 6*a*, the slot 72 in the second end 38 of the connecting member 30 allows for smooth operation of the camming device without the pin 50 causing a side load in the connecting member 30. This preferred arrangement allows for a very smooth operation of the camming device 40. Alternatively, cam portion 46 may have a slot therein and the second end 38 of the connecting member 30 may have a pin engaging this slot. As further alternatives, the camming device may engage the second side portion 14 in other ways and the need for a slot in the connecting member or cam portion may be eliminated.

For some applications, it is desirable for the mounting device to include a locking mechanism that retains the mounting device in its clamped or locked position until the locking mechanism is disengaged. Such a locking mechanism is not required for all embodiments of the present invention. However, one embodiment of a locking mechanism that may be used with embodiments of the present invention is illustrated in FIGS. 1-6*a*. As best shown in FIGS. 3 and 6*a*, the locking mechanism includes a locking element 80 that extends from the fixed side portion 14 and engages the lever 44 of the camming device 40. The locking element 80 has a base 82 that is interconnected with the fixed side portion 14 by a pin 84. A second end of the locking element 80 forms a catch 86. The lever 44 may have an opening 88 defined therethrough. As best shown in FIG. 6*a*, when the lever 44 is in a closed position, the locking element 80 extends through the opening 88 and the catch 86 engages the outer surface of the lever, thereby retaining it in the latched position. An O-ring 90 acts as a spring to bias the locking element 80 into a position generally perpendicular to the fixed side portion 14. This also serves as a position in which the catch engages the lever 44. The locking element can be disengaged by pushing the catch inwardly towards the cam portion 46 of the camming device until the catch is positioned to pass through the opening 88. At this point, the lever freely rotates to an open position. When the lever 44 is again returned to the closed position, the locking element again engages the lever and holds it in this position.

Figure 6B:
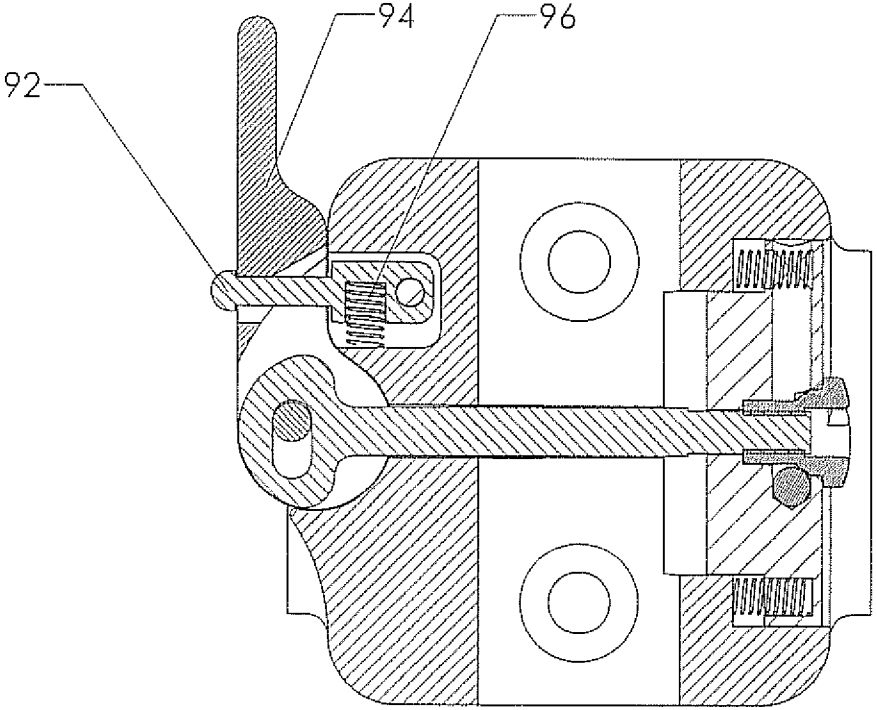
FIG. 6*b* is a cross-sectional view similar to FIG. 6, but of a mounting device according to the present invention with an alternative locking mechanism.

Referring now to FIG. 6*b*, a cross-sectional view similar to FIG. 6*a* is provided for a mounting device with an alternative locking mechanism. As with the version of FIG. 6*a*, the locking mechanism includes a locking element 92 that engages the lever 94. However, this alternative differs in that the locking element 92 is biased into its locking position by a small coil spring 96.

Referring now to FIGS. 7-12, a second embodiment of a mounting device according to the present invention is illustrated in various views. Many aspects of this embodiment of the mounting device 110 are the same as for the mounting device 10. The primary difference between the two embodiments is in the locking mechanism. The mounting device 110 includes a locking element 112 that takes the form of a pivoting latch. The pivoting latch 112 is pivotally connected to the body 114 of the mounting device at a pin or pivot 116. The latch 112 includes a catch 118 that engages a notch or recess 120 in the cam portion of the camming device 122. As will be clear to those of skill in the art, the latch 112 may be configured in various ways and engage the camming device 122 in various ways. In the illustrated embodiment, the catch 118 engages a notch 120 in the cam portion 124 of the lever 122. When the locking mechanism is in the closed and latched position, the catch 118 prevents rotation of the camming device 122. The locking mechanism may be disengaged by pushing against area 126 of the latch. The area 126 may take the form of a button or receiving area for an operator's finger. The camming device 122 may then be rotated to an open position. A spring 127 biases the catch 118 into the locked position. As such, when the camming device 122 is moved back to the closed position, the catch 118 returns to the locked position.

In the illustrated embodiment, the latch 112 has a pivot end 128 that is pivotally interconnected with the base portion or side portion of the mounting device by a pivot pin 130. The area 126 is between the pivot end 128 and the catch 118.

Figure 7:
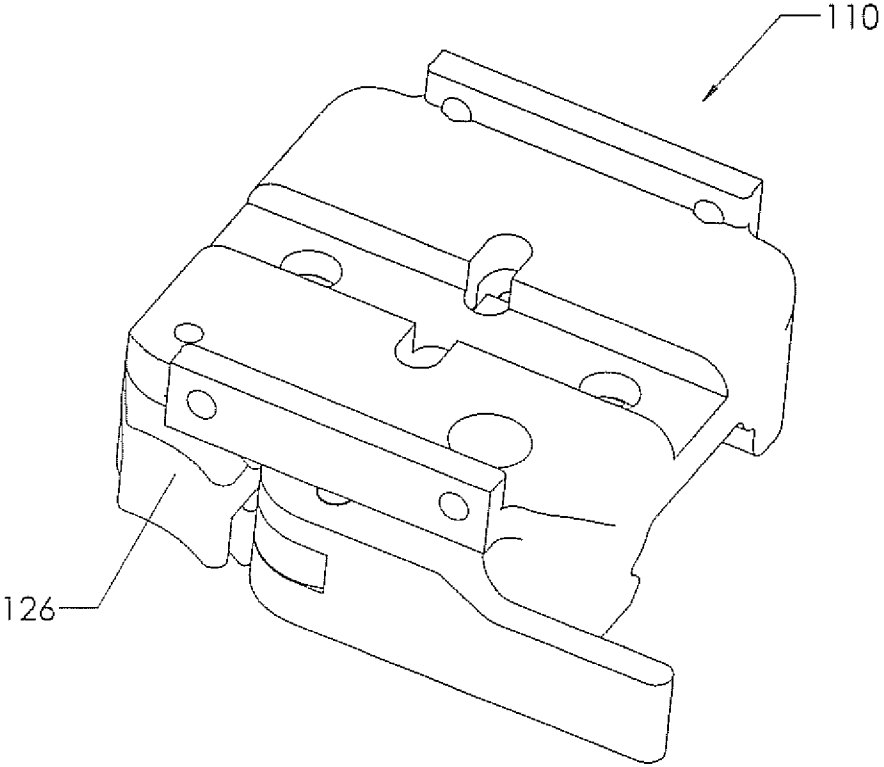
FIG. 7 is a perspective view of the second embodiment of a mounting device according to the present invention.
Figure 8:
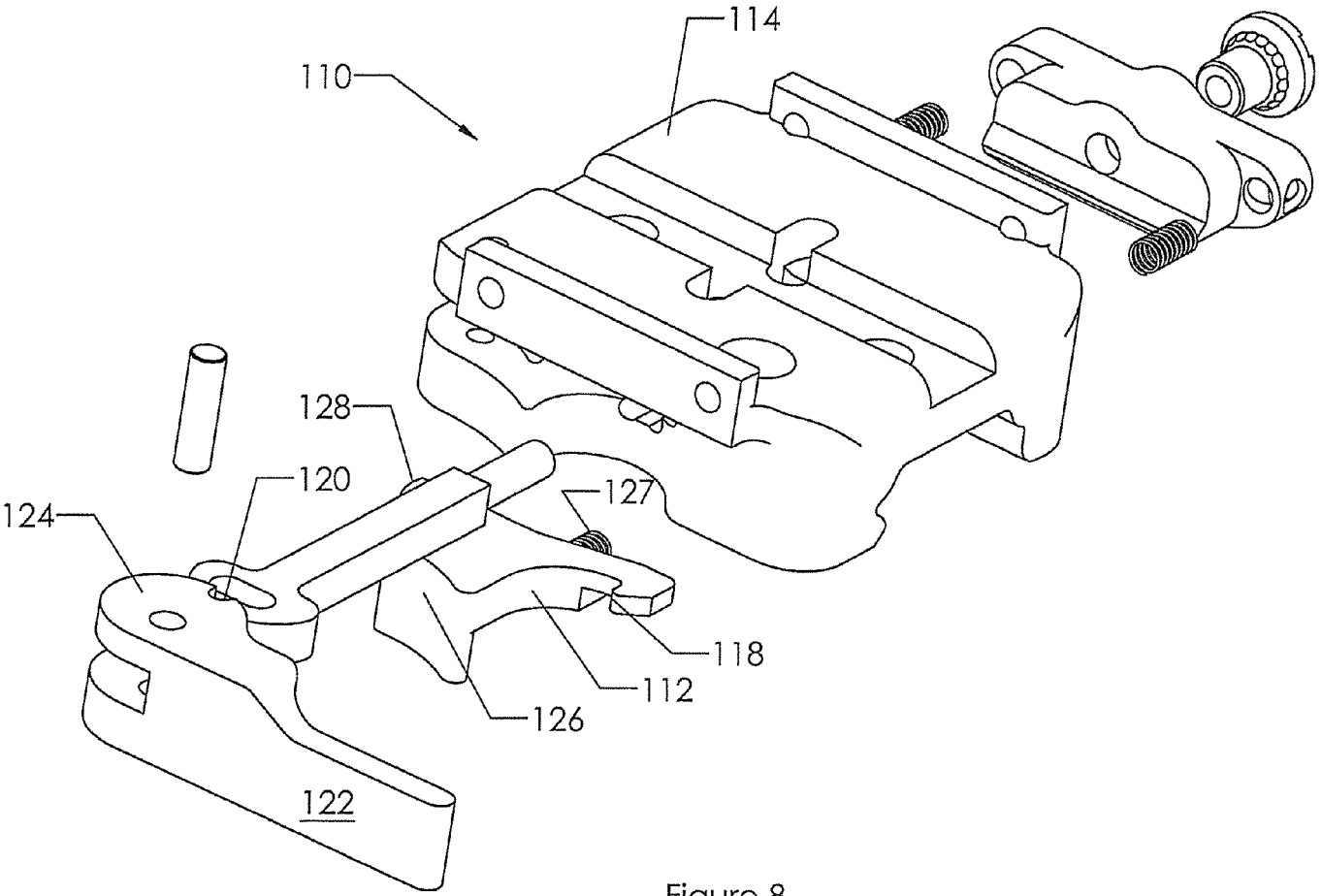
FIG. 8 is an exploded perspective view of the mounting device of FIG. 7.
Figure 9:
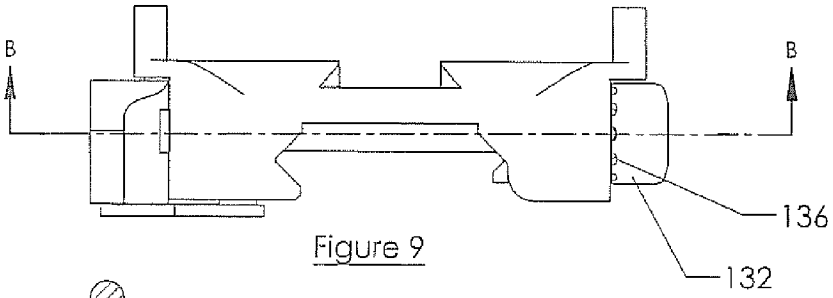
FIG. 9 is a side view of the mounting device of FIGS. 7 and 8.
Figure 10:
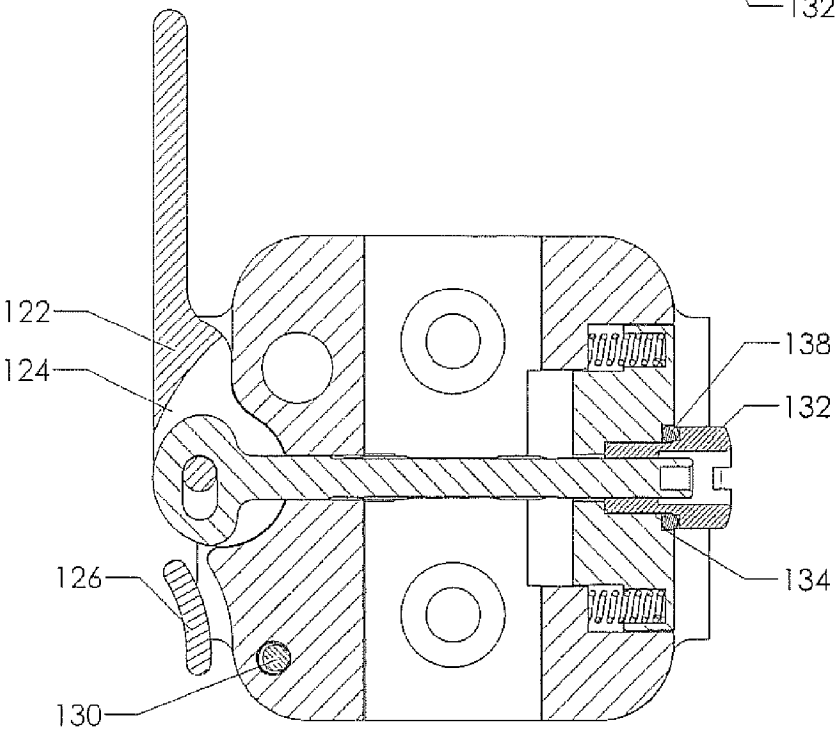
FIG. 10 is a cross-sectional view of the mounting device of FIGS. 7-9, taken along the lines B-B of FIG. 9.
Figure 11:
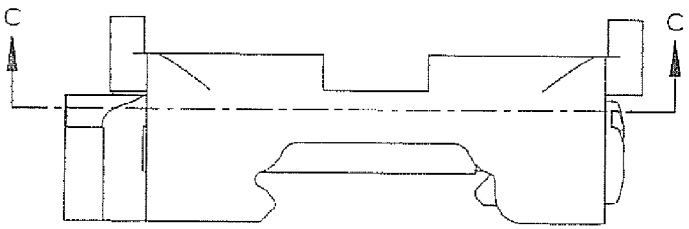
FIG. 11 is an end-view of the mounting device of FIGS. 7-10.
Figure 12:
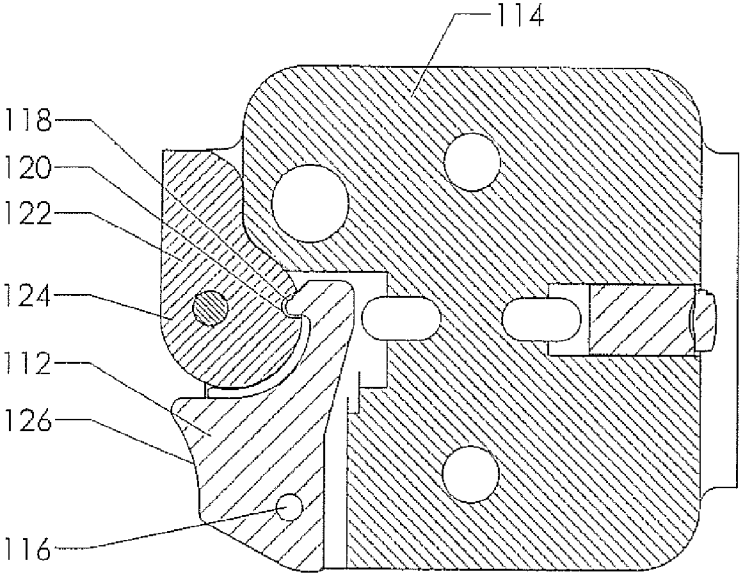
FIG. 12 is a cross-sectional view of the mounting device of FIGS. 7-11, taken along the lines C-C of FIG. 12.
Figure 13:
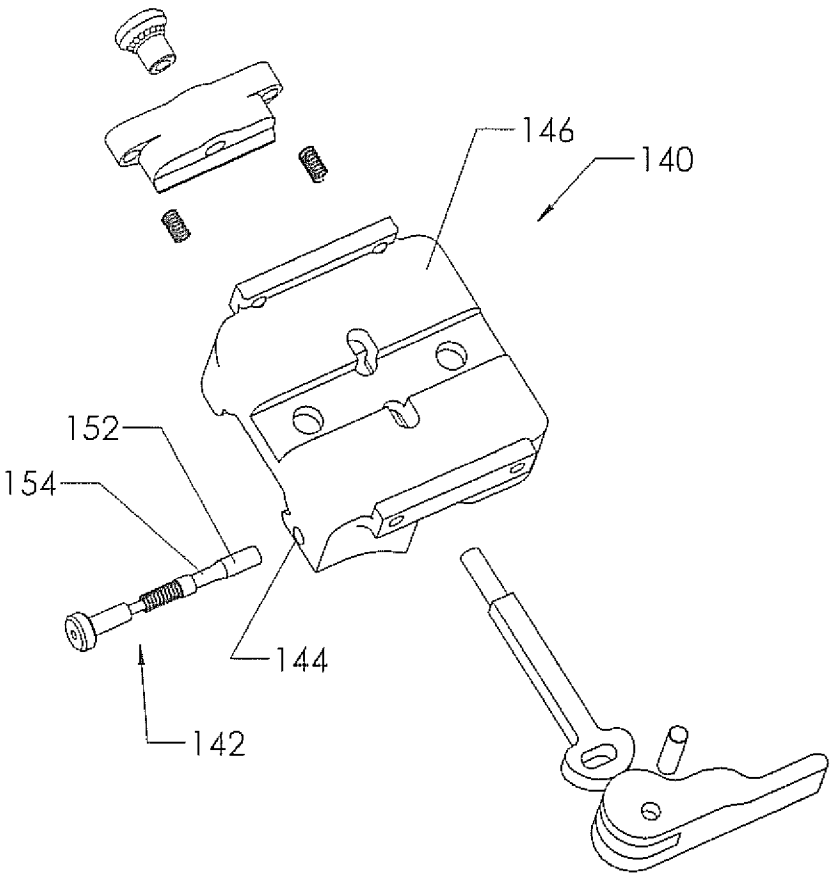
FIG. 13 is an exploded perspective view of a third embodiment of a mounting device according to the present invention.

Referring to FIGS. 9 and 10, a variation of the mount of FIGS. 7 and 8 is shown. In this version, the adjusting nut 132 and the nut receiving area 134 are configured differently. The nut 132 is more squared off such that the detents 136 in the nut are in a flat surface rather than a tapered surface. One or more hardened balls 138 are disposed on the nut receiving area 134, but are embedded in the surface rather than in a drilled recess, thereby simplifying assembly. As with the earlier embodiments, the nut receiving area takes the form of a recess and the nut 132 is at least partially received therein.

Figure 14:
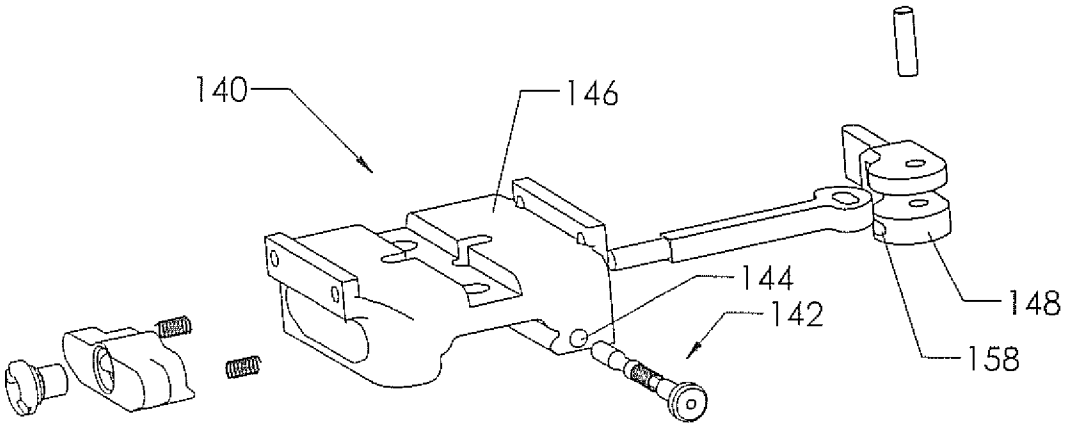
FIG. 14 is another exploded perspective view of the mounting device of FIG. 13, taken from a different angle.
Figure 15:
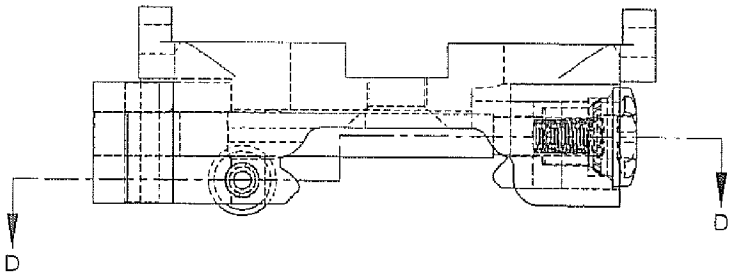
FIG. 15 is an end-view of the mounting device of FIGS. 13 and 14.
Figure 16:
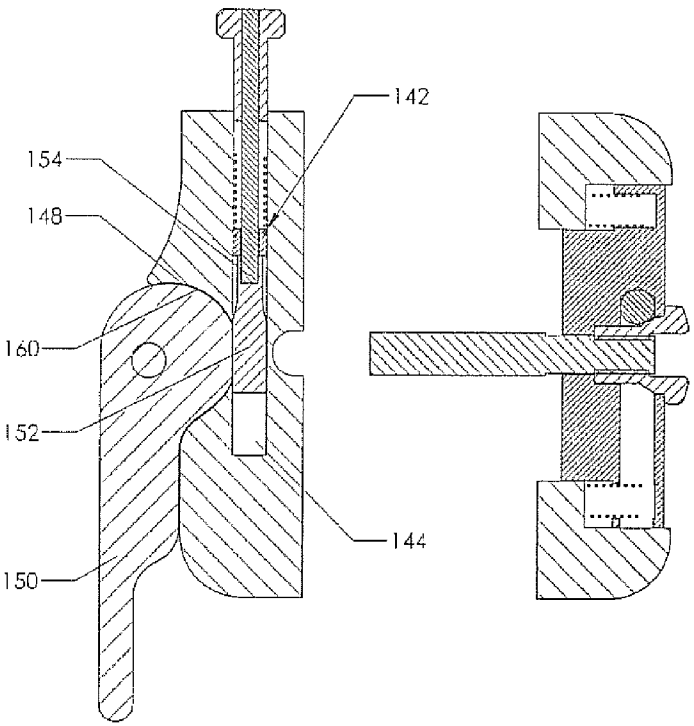
FIG. 16 is a cross-sectional view of the mounting device of FIGS. 13-15, taken along the lines D-D of FIG. 15.
Figure 17:
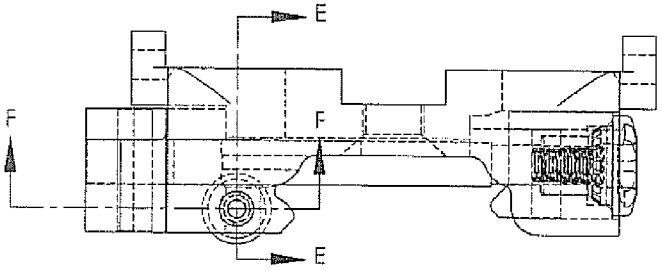
FIG. 17 is another end-view of the mounting device of FIGS. 13-16.
Figure 19:
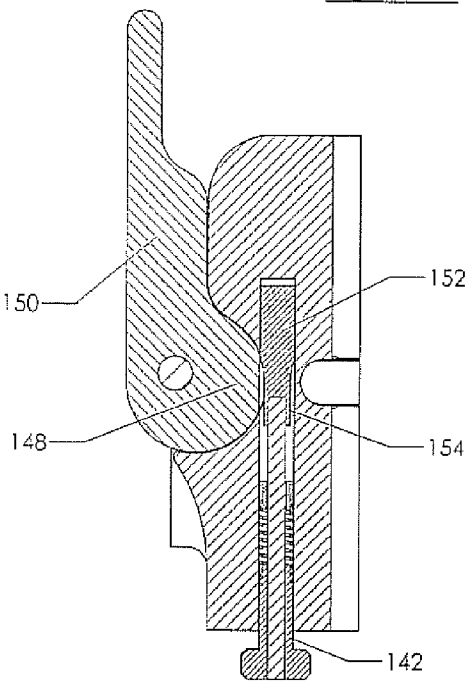
FIG. 19 is a cross-sectional view of a portion of the mounting device of FIGS. 13-18, taken along the lines F-F of FIG. 17.
Figure 18:
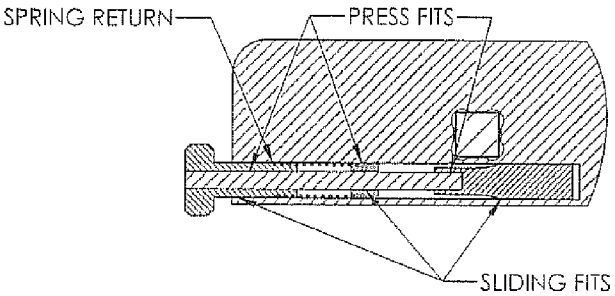
FIG. 18 is a cross-sectional view of a portion of the mounting device of FIGS. 13-17, taken along the lines E-E of FIG. 17.
Figure 20:
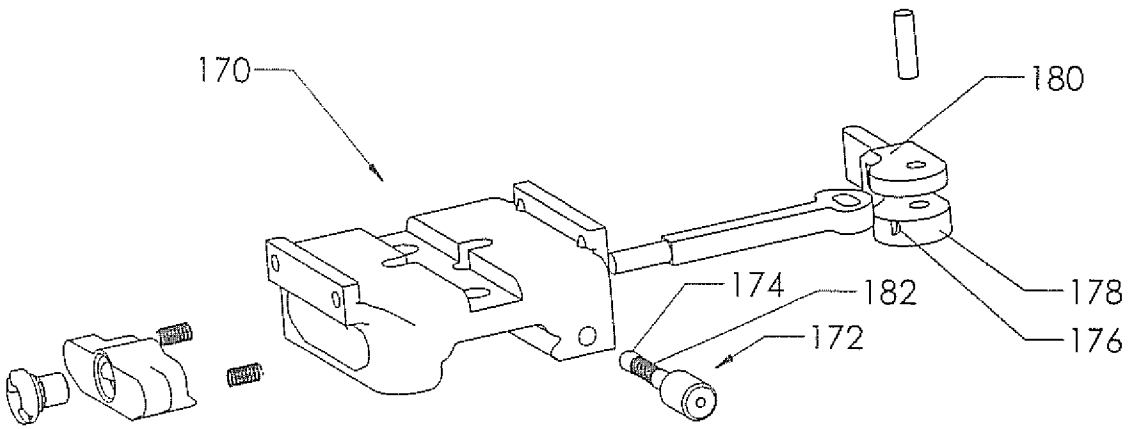
FIG. 20 is an exploded perspective view of the fourth embodiment of a mounting device according to the present invention.
Figure 21:
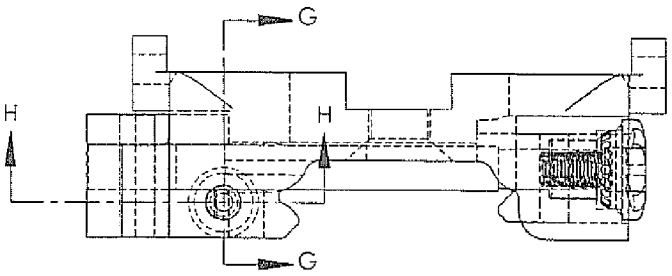
FIG. 21 is an end-view of the mounting device of FIG. 20.
Figure 23:
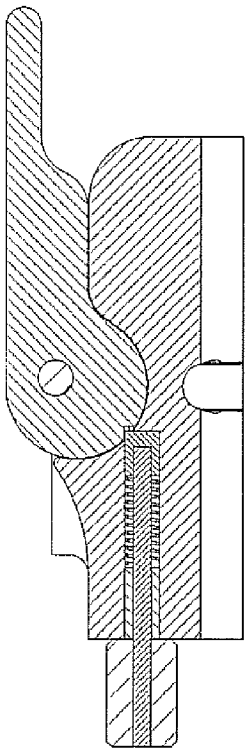
FIG. 23 is a cross-sectional view of a portion of the mounting device of FIGS. 20-22, taken along the lines H-H of FIG. 21.
Figure 22:
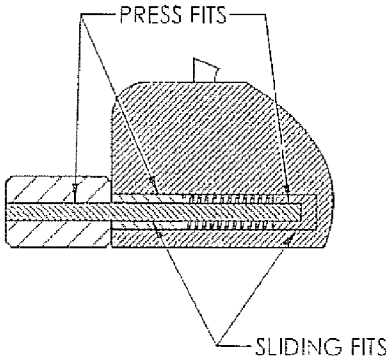
FIG. 22 is a cross-sectional view of the portion of the mounting device of FIGS. 20 and 21, taken along the lines G-G of FIG. 21.
Figure 24:
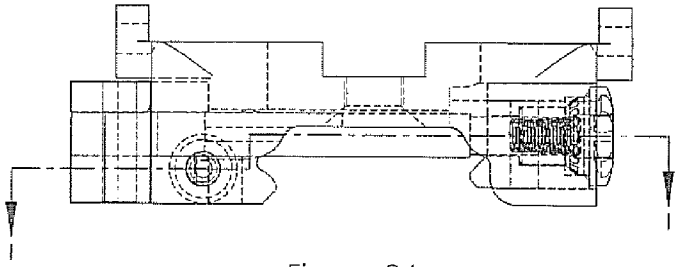
FIG. 24 is another end-view of the mounting device of FIGS. 20-23.
Figure 25:
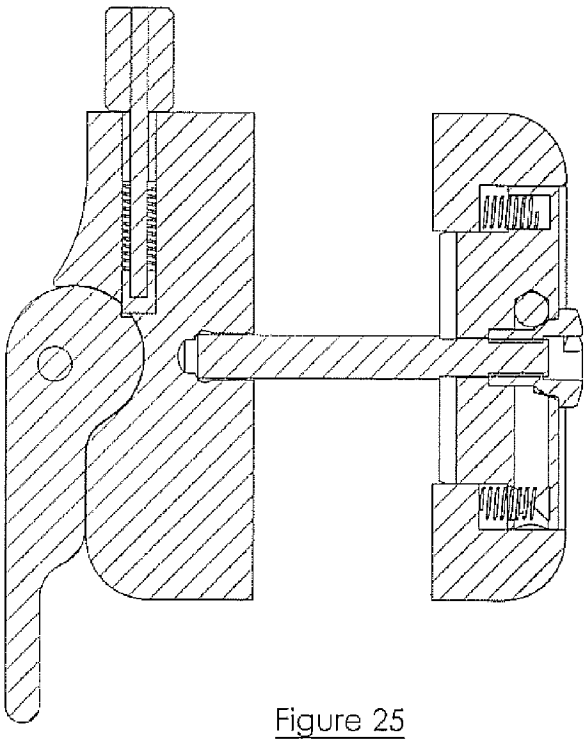
FIG. 25 is a cross-sectional view of a portion of the mounting device of FIGS. 20-24, taken along the lines I-I of FIG. 24.

A third embodiment of a mounting device according to the present invention is shown in FIGS. 13-19. Again, this mounting device 140 is similar in most ways to the earlier embodiments of the mounting device. It differs primarily in using a different type of locking mechanism. The mounting device 140 uses a push button locking mechanism. The locking element is generally shown at 142 and takes the form of a plunger received in a bore 144 in the body 146 of the mounting device 140. This bore may be said to be in the base portion or the side portion of the body 146. The bore 144 extends adjacent the cam surface 148 of the lever 150, thereby intersecting the curved cam receiving surface 160. The plunger 142 has a first portion 152 and a second portion 154, with the second portion 154 being narrower than the first portion 152. In the lock position shown in FIG. 16, the first portion 152 is adjacent the cam portion 148 of the camming device 150. As best shown in FIG. 14, the cam portion 148 has a relieved area 158 which is engaged by the first portion 152 of the plunger 142 in the lock position. As shown in FIG. 19, the plunger 142 may be depressed such that the first portion 152 is moved out of alignment with the cam portion 148 and the second portion 154 is moved into alignment. Because the second portion 154 is narrower, this allows the camming device 150 to be rotated from the closed to the open position. The plunger 142 may be spring-loaded as illustrated. FIG. 18 is labeled to illustrate a spring and what portions of the locking mechanism are press fit or sliding fit.

Referring now to FIGS. 20-25, a fourth embodiment of a mounting device according to the present invention is shown at 170. Again, the mounting device 170 is similar to the prior embodiments, but differs in using a different locking mechanism. The locking element in the embodiment of FIGS. 20-25 takes the form of a spring-loaded locking shaft 172 with an end 174 that serves as a catch by engaging a detent 176 in the cam portion 178 of the camming device 180. The locking shaft 172 may be pulled outwardly against the bias of the spring 182, thereby causing the end 174 to disengage from the detent 176, allowing the camming device 180 to be rotated to the open position.

As will be clear to those of skill in the art, the various embodiments of the present invention described herein may be altered without departing from the scope or teaching of the present invention. It is the following claims, including all equivalents, which define the scope of the invention.

We claim:

1. A mounting device for mounting an accessory to a rail of a weapon, the mounting device comprising:

a base portion;

a first side portion configured to engage a first side of a rail of a weapon;

a second side portion configured to engaged a second side of a rail of a weapon, the second side being opposite the first side;

one of the side portions being movable relative to the other of the side portions such that the side portions cooperate to selectively grip the rail of the weapon;

an elongated connecting member having a first end engaging the first side portion;

a camming device interconnected with a second end of the elongated connecting member, the camming device engaging the second side portion and being operable to pull the elongated connecting member such that the side portions are moved from a released position to an engaged position, the camming device including a lever that moves the camming device between an open and a closed position; and a locking mechanism operable to lock the camming device in the closed position, the locking mechanism including a latch that is pivotally interconnected with the base portion or the second side portion and movable between a lock position and an unlock position, the locking element having a catch that selectively engages the camming device when the locking element is in the lock position thereby locking the camming device in the closed position.

2. A mounting device in accordance with claim 1, wherein:

the latch further includes a pivot end that is pivotally interconnected with the base portion or the second side portion and a catch end including the catch, a button defined between the pivot end and the catch end for moving the latch.

3. A mounting device in accordance with claim 1, further comprising:

a spring biasing the latch towards the lock position.

4. A mounting device in accordance with claim 1, wherein:

the camming device has a cam portion with a recess defined therein, the catch engaging the recess in the lock position.

5. A mounting device in accordance with claim 1, wherein:

the base portion has an opening defined therein;

the movable one of the side portions is slidingly received in the opening; and the other of the side portions being fixed with respect to the base portion.

6. A mounting device in accordance with claim 5, wherein:

the first side portion is the movable side portion; and the second side portion is the side portion that is fixed with respect to the base portion.

7. A mounting device in accordance with claim 6, wherein:

the second side portion is integral with the base portion.

8. A mounting device in accordance with claim 5, further comprising a spring biasing the movable one of the side portions away from the other of the side portions.

9. A mounting device in accordance with claim 1, wherein:

the camming device includes a cam portion interconnected with the second end of the connecting member, the second end of the connecting member or the cam portion having a slot disposed therein, a pin interconnecting the other of the second end or the cam portion with the slot.

10. A mounting device in accordance with claim 1, wherein:

the second side portion has a curved cam receiving surface defined thereon, the cam portion of the camming device being disposed against the curved cam receiving surface.

11. A mounting device in accordance with claim 1, wherein:

the elongated connecting member has a mid portion extending between the first and second ends;

the first end of the connecting member comprising an adjusting nut threadingly engaged with the mid portion;

the second side portion having a nut receiving area defined thereon;

the adjusting nut being disposed so as to engage the nut receiving area; and the nut receiving area and the adjusting nut having corresponding engagement features such that when the adjusting nut is disposed in engagement with the receiving area, the engagement features engage each other.

12. A mounting device in accordance with claim 11, wherein:

the engagement features comprise a hardened ball in the nut receiving area and a plurality of detents defined on the nut.

13. A mounting device in accordance with claim 11, wherein:

the nut receiving area is a nut receiving recess, the nut being at least partially received in the nut receiving recess.

14. A mounting device in accordance with claim 11, further comprising:

a spring biasing the second side portion towards the adjusting nut.

15. A mounting device in accordance with claim 1, further comprising:

an accessory mounted to the base portion.

16. A mounting device in accordance with claim 15, wherein:

the accessory comprises a scope.

17. A mounting device for mounting an accessory to a rail of a weapon, the mounting device comprising:

a base portion having an opening defined therein;

a first side portion configured to engage a first side of a rail of a weapon;

a second side portion configured to engaged a second side of a rail of a weapon, the second side being opposite the first side, the side portions cooperating to selectively grip the rail of the weapon, the second side portion having a curved cam receiving portion defined thereon;

the first side portion slidingly received in the opening in the base portion so as to be movable relative to the second side portion;

an elongated connecting member having a first end, a second end and a mid portion extending therebetween, the first end comprising an adjusting nut threadingly engaged with the mid portion, the adjusting nut engaging the first side portion;

a camming device interconnected with the second end of the elongated connecting member, the camming device having a cam portion engaging the curved cam receiving surface of the second side portion and a lever that moves the camming device between an open and a closed position, the camming device being operable to pull the elongated connecting member such that the side portions are moved from a released position to an engaged position; and a locking mechanism operable to lock the camming device in the closed position, the locking mechanism including a latch that pivots between a latched and an unlatched position, the latch being pivotally interconnected and directly attached with the base portion or the second side portion, the latch having a catch that engages a recess in the camming device in a lock position thereby locking the camming device in the closed position.

18. A mounting device for mounting an accessory to a rail of a weapon, the mounting device comprising:

a base portion;

a first side portion configured to engage a first side of a rail of a weapon;

a second side portion configured to engage a second side of a rail of a weapon, the second side opposite the first side;

one of the side portions being movable relative to the other of the side portions such that the side portions cooperate to selectively grip the rail of the weapon;

an elongated connecting member having a first end and an opposed second end with a mid portion extending therebetween, the first end comprising an adjusting nut threadingly engaged with the mid portion, the first side portion having a nut receiving area defined thereon, the adjusting nut being disposed so as to engage the nut receiving area, the nut receiving area and the adjusting nut having corresponding engagement features such that when the adjusting nut is disposed in engagement with the nut receiving area, the engagement features engage each other, the engagement features comprising a hardened ball in the nut receiving area and a plurality of detents defined on the nut, the nut having an underside facing the nut receiving area, the plurality of detents being defined in the underside of the nut and being continuously adjacent each other so as to allow small incremental adjustments; and a camming device interconnected with the second end of the elongated connecting member, the ramming device operable to pull the elongated connecting member such that the side portions are moved from a released position to an engaged position, the camming device including a lever that is moved between an open and a closed position.

19. The mounting device in accordance with claim 18, wherein the base portion has an opening defined therein and the movable one of the side portions is slidingly received in the opening, the other of the side portions being fixed with respect to the base portion.

20. A mounting device for mounting an accessory to a rail of a weapon, the mounting device comprising:

a base portion;

a first side portion configured to engage a first side of a rail of a weapon;

a second side portion configured to engage a second side of a rail of a weapon, the second side opposite the first side;

one of the side portions being movable relative to the other of the side portions such that the side portions cooperate to selectively grip the rail of the weapon;

an elongated connecting member having a first end engaging the first side portion; and a camming device interconnected with a second end of the elongated connecting member, the camming device operable to pull the elongated connecting member such that the side portions are moved from a released position to an engaged position, the camming device including a lever that is moved between an open and a closed position and a cam portion interconnected with the second end of the connecting member, the second end of the connecting member or the cam portion having an elongated slot disposed therein, a pin interconnecting the other of the second end or the cam portion with the slot, the slot having a length that is greater than a width of the pin.

21. A mounting device in accordance with claim 20, further comprising:

a locking element extending from the second side portion to an outer end with a catch, the catch selectively engaging and retaining the lever in the closed position.

22. A mounting device in accordance with claim 21, wherein:

the base portion has an opening defined therein;

the movable one of the side portions is slidingly received in the opening; and the other of the side portions being fixed with respect to the base portion.

23. A mounting device in accordance with claim 20, wherein:

the second side portion has a curved cam receiving surface;

the camming device has a cam portion disposed against the curved cam receiving surface; and the second side portion having a bore defined therein, the bore intersecting the curved cam receiving surface; and further comprising a locking element being received in the bore, the locking element having an engagement end that engages the cam portion of the camming device in the lock position.

24. A mounting device in accordance with claim 23, wherein:

the locking element in the lock position extends into engagement with the cam portion and in the unlock position is retracted so as not to engage the cam portion.

25. A mounting device in accordance with claim 23, wherein:

the engagement end of the locking element includes a first portion and a second portion, the second portion having a thickness less than the first portion;

the locking element movable between a lock position wherein the first portion is adjacent the cam portion and an unlock position wherein the second portion is adjacent the cam portion, the first portion in the lock position blocking rotation of the camming device, and the second portion in the unlock position not blocking rotation of the camming device.

26. The mounting device of claim 20, wherein the second side portion has a curved cam receiving surface, the cam portion of the camming device being disposed against the curved cam receiving surface.

27. The mounting device in accordance with claim 20, wherein the base portion has an opening defined therein and the movable one of the side portions is slidingly received in the opening, the other of the side portions being fixed with respect to the base portion.

* * * * *

UNITED STATES PATENT AND TRADEMARK OFFICE

CERTIFICATE OF CORRECTION

PATENT NO. : 8,438,965 B2
APPLICATION NO. : 12/819506
DATED : May 14, 2013
INVENTOR(S) : Collin et al.

It is certified that error appears in the above-identified patent and that said Letters Patent is hereby corrected as shown below:

In the Claims:

Column 9, claim 1, line 28, Delete “engaged”, Insert --engage--.

Column 10, claim 17, line 66, Delete “engaged”, Insert --engage--.

Signed and Sealed this
Twenty-first Day of October, 2014

Michelle K. Lee

Michelle K. Lee
*Deputy Director of the United States Patent and Trademark Office*